US007107003B2

(12) United States Patent
Sohn

(10) Patent No.: US 7,107,003 B2
(45) Date of Patent: Sep. 12, 2006

(54) IMAGE FORMING APPARATUS AND DOCUMENT SIZE DETERMINATION METHOD THEREOF

(75) Inventor: Seung-oh Sohn, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 34 days.

(21) Appl. No.: 10/920,179

(22) Filed: Aug. 18, 2004

(65) Prior Publication Data

US 2005/0069359 A1 Mar. 31, 2005

(30) Foreign Application Priority Data

Sep. 29, 2003 (KR) ..... 10-2003-0067595

(51) Int. Cl.
*G03G 15/00* (2006.01)

(52) U.S. Cl. ..... 399/370; 399/376; 358/449

(58) Field of Classification Search ..... 399/370, 399/376, 389; 355/56, 75; 358/449; 382/286; 400/708

See application file for complete search history.

(56) References Cited

U.S. PATENT DOCUMENTS 5,036,354 A * 7/1991 Miyamoto ..... 355/75
5,061,962 A * 10/1991 Takahashi ..... 399/205
5,321,273 A * 6/1994 Kamiyama et al. .... 250/559.24
5,500,725 A * 3/1996 Takasu et al. ..... 399/17
6,766,139 B1 * 7/2004 Chueh et al. ..... 399/376

FOREIGN PATENT DOCUMENTS

| | | | |
|---|---|---|---|
| JP | 58207035 | | 12/1983 |
| JP | 59042559 | | 3/1984 |
| JP | 59133537 | | 7/1984 |
| JP | 59133537 | A * | 7/1984 |
| JP | 59-133537 | | 9/1984 |
| JP | 61286839 | | 12/1986 |
| JP | 09244162 | | 9/1997 |
| JP | 11295824 | | 10/1999 |
| JP | 11295824 | A * | 10/1999 |

* cited by examiner

*Primary Examiner*—Ren Yan
(74) *Attorney, Agent, or Firm*—Roylance, Abrams, Berdo & Goodman, LLP

(57) ABSTRACT

A image-forming apparatus has a light projection unit for projecting light onto a document. A reflection plate having a predetermined pattern corresponding to a size of the document reflects the light projected onto the document. The light reception unit receives the reflected light and forms an image. A control unit determines the size of the document based on the width of the document according to the pattern appearing on the image. When photocopying documents of several sizes using an automatic document feeder, documents are sorted based the document sizes and therefore, the documents can be read out at once without requiring resetting of the image forming apparatus for different document sizes.

8 Claims, 3 Drawing Sheets

| VARIABLE A (DOCUMENT LENGTH) / VARIABLE B (DOCUMENT WIDTH) | A4 (PORTRAIT ORIENTATION) | LETTER (PORTRAIT ORIENTATION) | LETTER (LANDSCAPE ORIENTATION) | A4 (LANDSCAPE ORIENTATION) | LEGAL | A3 |
|---|---|---|---|---|---|---|
| A4 (LANDSCAPE ORIENTATION) | X | X | X | O | X | X |
| LEGAL, LETTER (LANDSCAPE ORIENTATION) | X | X | O | X | O | X |
| LETTER (PORTRAIT ORIENTATION) | X | O | X | X | X | X |
| A4 (PORTRAIT ORIENTATION), A3 | O | X | X | X | X | O |

IMAGE FORMING APPARATUS AND DOCUMENT SIZE DETERMINATION METHOD THEREOF

CROSS-REFERENCE TO RELATED APPLICATIONS

This application claims the benefit under 35 U.S.C. § 119(a) of Korean Patent Application No. 2003-67595, filed on Sep. 29, 2003, in the Korean Intellectual Property Office, the entire disclosure of which is incorporated herein by reference.

BACKGROUND OF THE INVENTION

1. Field of the Invention

The present invention relates to an image forming apparatus and a document size determination method thereof. More particularly, the present invention relates to a document size determination device for an image forming apparatus and a document size determination method thereof capable of determining the size of a document fed by an automatic document feeder and feeding a sheet of copy paper of a size corresponding to the document.

2. Description of the Related Art

In a conventional image-forming apparatus such as a scanner, a facsimile machine, a photocopier, and so on, a user has to set documents sheet by sheet to read out images of the documents. The user also has to input the sizes of the set documents one by one.

However, with the automatic document feeder installed, a large image-forming apparatus can automatically read out plural documents at a time. The automatic document feeder can automatically feed and set documents to a position for reading out images so as to enable the image-forming apparatus to read out document images, when a user loads a plurality of documents onto a document feeder tray at one time.

That is, when the automatic document feeder is used, the plurality of loaded documents are picked up one by one, and fed along a document transfer path, so that the image of the fed document is by the image-forming apparatus, and then transferred to a document outlet. Therefore, the plurality of documents can be automatically read out without manipulation by the users when the automatic document feeder is used.

Thus, even when a user wants to have plural documents read out, the user does not have to set the documents one by one since the documents are to be automatically and conveniently read out. However, the automatic document feeder has a problem when the sizes of plurality of documents are different.

That is, as a user sets two or more sizes of documents into an image-forming apparatus, the image-forming apparatus supplies a sheet of paper based on the size of a document read out for the first time, and then reads the image of the document, so that a next document fed in after and possibly larger in size than the first read-out document is only partially read out causing the image of the document to be partially cut off.

Further, when a document to be read out next time is smaller in size than the document read out for the first time, the next document is copied on a sheet of paper larger in size, which wastes paper as well as forms an image having a blank space that the user does not want.

Furthermore, even if the next document has the same size as the first document, the same problem occurs when documents are loaded onto the automatic document feeder in a different orientation from the first document, that is, in a portrait or a landscape orientation different from the first document.

Accordingly, in the case of reading out documents of two or more sizes loaded onto the document tray of the automatic document feeder, there exists a problem in that a user can read out the documents only after sorting the documents by size and setting only the documents having the same size on the document tray. Then, the user has to reset the image forming apparatus for different documents in size since the different sized documents can not be set at one time.

SUMMARY OF THE INVENTION

Accordingly, it is an aspect of the present invention to provide an image forming apparatus and a document size determination method thereof which determine the sizes of plural kinds of documents fed by an automatic document feeder and automatically supply sheets of paper of corresponding sizes by the document feeder.

In order to achieve the above aspect, an image forming apparatus comprises a light projection unit for projecting light onto a document, a reflection plate having a predetermined pattern corresponding to a size of the document, and for reflecting the light projected onto the document. The image forming apparatus also comprises a light reception unit for receiving the reflected light and forming an image; and a control unit for determining the size of the document based on the width of the document according to a pattern appearing on the image.

Preferably, the image forming apparatus further comprises a document sensing unit disposed on a path along which the document is fed to the reflection plate, wherein the control unit measures the time during which the document passes through the document sensing unit and determines the document size based on a length of the document.

Further, preferably, the control unit combines the document sizes based on the document width and length and determines the document size, and the predetermined pattern is preferably a plurality of marks located in predetermined positions according to document sizes based on document width.

Further, in order to achieve the above aspect, a document size determination method for image-forming apparatuses according to the present invention comprises steps of projecting light onto a document in order to reflect the light projected onto the document by a reflection plate provided with a predetermined pattern corresponding to a size of the document; receiving the reflected light and forming an image; and determining a size of the document based on a width of the document according to a pattern appearing on the image.

Preferably, the document size determination method further comprises a step of measuring time during which the document passes through the document sensing unit disposed on a path along which the document is fed to the reflection plate, and determining the document size based on a length of the document.

Preferably, the document size determination method further comprises a step of combining the document sizes based on the document width and length, and determining the document size. Further, the predetermined pattern is a plurality of marks marked according to document sizes based on document width.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

Hereinafter, the present invention will be described in detail with reference to the attached drawings.

Figure 1:
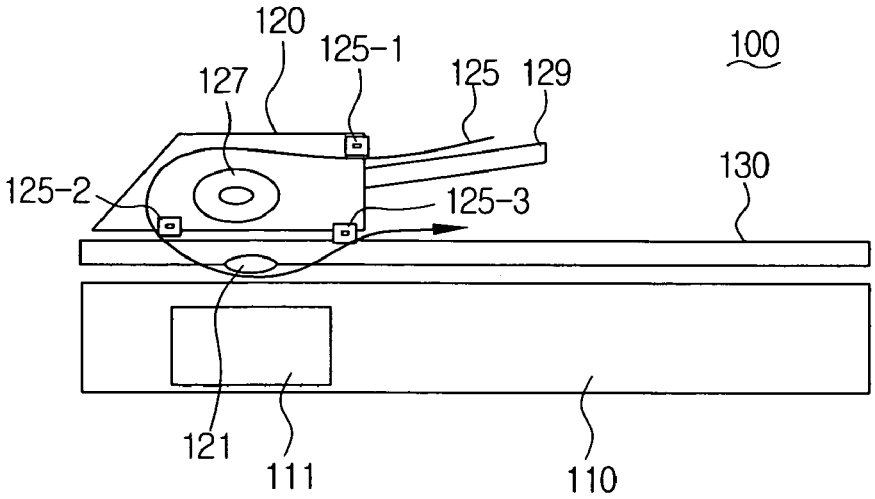
FIG. 1 is a view showing a part of an image-forming apparatus in which a document size determination device according to an embodiment of the present invention is mounted.

Referring to FIG. 1, an image-forming apparatus 100 has a flat bed 110, an automatic document feeder 120, and a document cover 130. A light projection unit 111 is disposed under a glass plate of the flat bed 110, and a motor 127 is mounted in the automatic document feeder 120 to operate several feeding rollers (not shown) for feeding documents.

Figure 2:
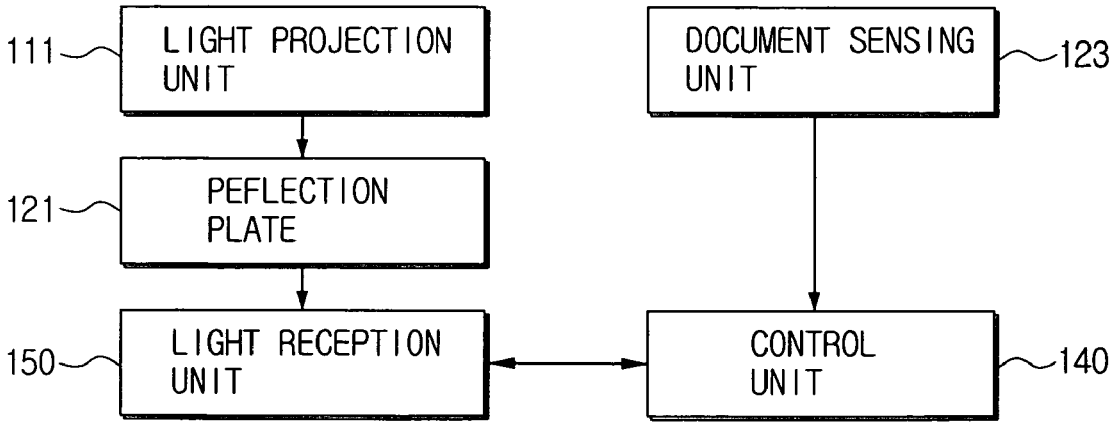
FIG. 2 is a block diagram showing the document size determination device for image-forming apparatuses according to an embodiment of the present invention.

Referring to FIG. 2, the document size determination device for an image forming apparatus includes the light projection unit 111, a reflection plate 121, a light reception unit 150, a control unit 140, and a document sensing unit 123.

The light projection unit 111 projects light onto a document. The projected light comes from a light source of the light projection unit 111. The document is fed under the reflection plate 121 by the automatic document feeder (not shown), and the light projected onto a position at which the document is fed under the reflection plate 121 is reflected by the reflection plate 121.

Figure 3:
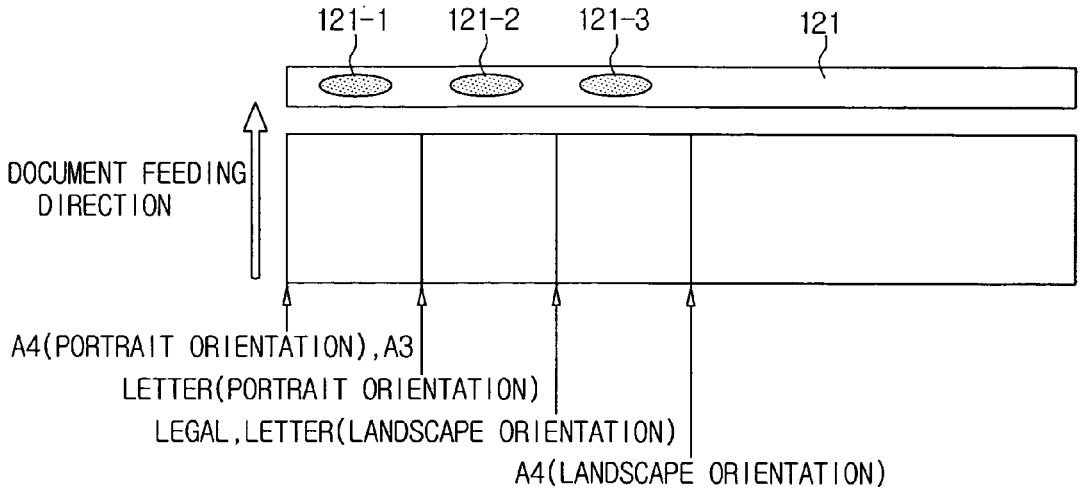
FIG. 3 is a view for showing in detail an exemplary reflection plate of FIG. 2 according to an embodiment of the present invention.

Further, the reflection plate 121 has a predetermined pattern corresponding to a size of a document. FIG. 3 is a view for illustrating in detail the reflection plate of FIG. 1. The pattern of the reflection plate 121 may be formed with marks 121-1, 121-2, and 121-3 located at the positions shown in FIG. 3, for example. The marks 121-1, 122-2, and 123-3 may be formed in any predetermined arbitrary shape.

Referring back to FIG. 1, the reflection plate 121 is mounted at the lower side of the document cover 130 in the document feeding path 125, and vertically over the position at which the light projection unit 111 under the flat bed 110 is disposed.

Referring back to FIG. 2, the light reception unit 150 receives the light reflected by the reflection plate 121 to form an image. The image is formed by the reflection of the document positioned at the reflection plate 121, so the pattern appearing on the image becomes different based on which of the marks, 121-1, 121-2, 121-3 of the reflection plate 121 are covered by the document.

For example, if a document is legal sized, the document covers up the mark 121-3, so the mark 121-3 does not appear, but the marks 121-1 and 121-2 appear as a pattern on the formed image.

The control unit 140 determines a size of the document based on the pattern appearing in the image formed by the light reception unit 150. The above example shows that the size of the document is determined by whether the respective marks 121-1, 121-2, and 121-3 shown in FIG. 3 appear on the formed image.

That is, if no mark appears at all, the size of the document is an A4 or an A3 size in portrait orientation. If only mark 121-1 appears, the size of the document is a letter size in portrait orientation. Further, if the marks 121-1 and 121-2 appear, the size of the document corresponds to a legal or a letter size in landscape orientation. If all the marks 121-1, 121-2, and 121-3 appear, the size of the document is an A4 size in landscape orientation.

The portrait orientation or the landscape orientation denotes an orientation in which documents are loaded on the document tray 129, and, since the light projected along the width direction of a document fed to the reflection plate 121 is reflected by the reflection plate 121, the determination of the size of the document is based on the pattern appearing on the image, which depends upon the width of the document. Accordingly, the size of the document can be determined differently based on the orientation. For example, when the A4 size document is loaded on the document tray 129, the A4 size document in landscape orientation will be wider than the A4 size document in portrait orientation.

Further, the document size determination device for image-forming apparatuses according to the present invention includes the document sensing unit 123 to determine the document size based on the length of the document. In FIG. 1, the document sensing unit 123 can be disposed at arbitrary positions 125-1, 125-2, and 125-3 along the document feeding path 125.

The document sensing unit 123 can operate in a manner that the document sensing unit 123 turns on when the front end of a document is sensed as the document is fed by the automatic document feeder 120 along the document feeding path 125 and turns off when the document passes through the document sensing unit 123 in the length direction of the document.

Thus, the document sensing unit 123 turns on while a document passes through the document sensing unit 123. Therefore, the turn-on time of the document sensing unit 123 can be calculated by measuring the number of pulses to drive the motor 127 provided in the automatic document feeder 120, for example. Such a calculation can be carried out by the control unit 140, and the control unit 140 calculates the length of the document based on the calculated time and determines a document size based on the length of the document.

Figure 4:
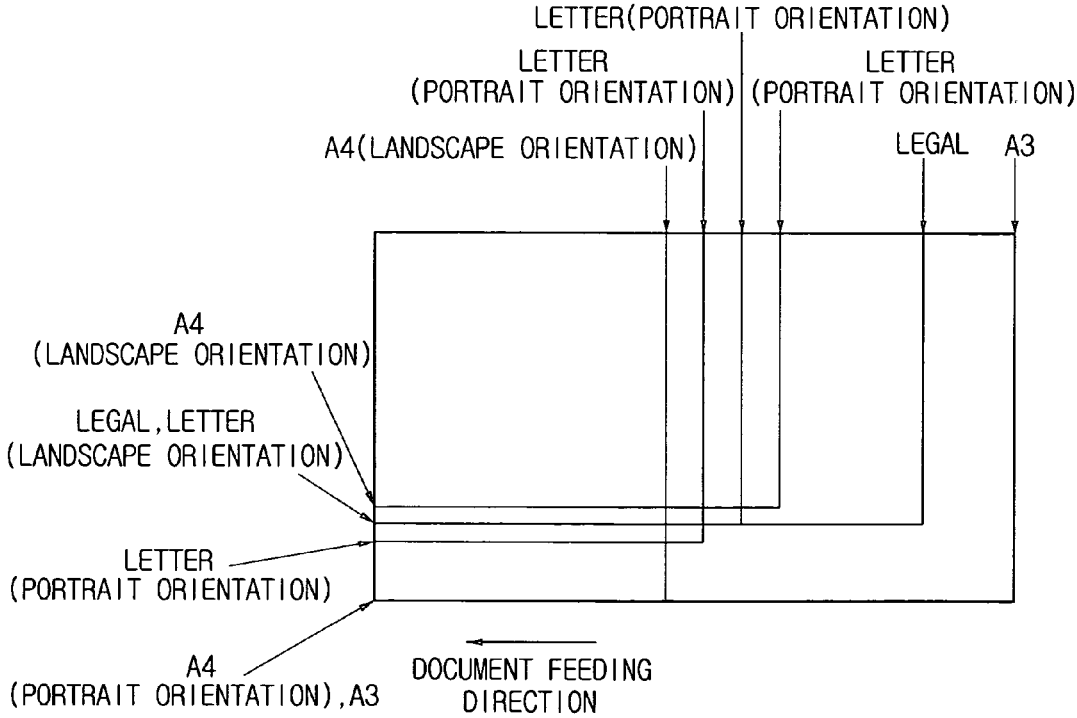
FIG. 4 is a view showing the kinds and sizes of documents that can be set in the image-forming apparatus.

In FIG. 4, there are the A4 size (portrait orientation and landscape orientation), legal size, letter size (landscape orientation and portrait orientation), and A3 size for document sizes, for example. As above, the landscape orientation refers to loading documents on the document tray in a fashion having the width of the documents longer than the length of the document.

Figures 5, 6:
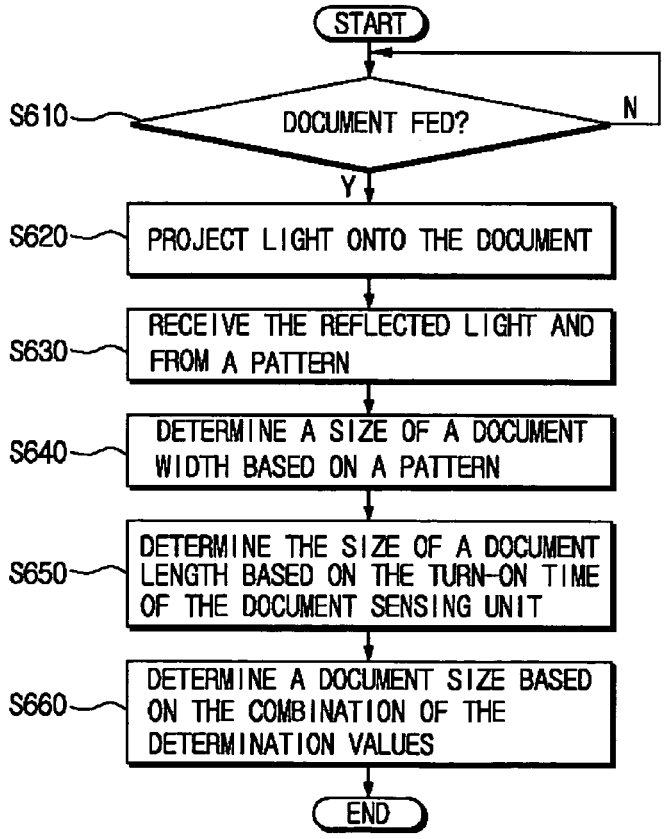
FIG. 5 is a table showing possible document sizes in combinations of document width and length according to an embodiment of the present invention.
FIG. 6 is a flow chart for showing a document size determination method according to an embodiment of the present invention.

Referring to FIG. 5, a document size can be determined in combination of the length (a variable A) of a document and the width (a variable B) of the document. For the length (the variable B) of the document, the width size is determined based on a pattern appearing on an image formed by the light reception unit 150.

That is, in case of the first row of a table of FIG. 5, all the marks 121-1, 121-2, and 121-3 appear so that the width size of a document is determined to be the A4 size in landscape orientation, and, in case of the second row of the table, two marks 121-1 and 121-2 appear so that the width size of the document is determined to be the legal size or the letter size in landscape orientation. Further, in case of the third row, only one mark 121-1 appears so that the width size of the document corresponds to the letter size in portrait orientation, and, in case of the fourth row, there is no mark appearing at all so that the width size of the document is the A4 size in portrait orientation or the A3 size in landscape orientation. Accordingly, the document width can be in plural sizes. In such an occasion, one document size can be determined as the width size of the document is combined with the length size of the same.

Referring to FIG. 5, in case that the width size of a document can be either the legal size or the letter size in landscape orientation, that is, in case of the second row, the document size is determined as one of the two sizes depending upon whether the size of a document length (the variable A) is the letter size in landscape orientation or the legal size.

Further, in case of the fourth row, the width size of a document can be the legal size or the letter size in landscape orientation, so that it is determined whether the document size is the letter size in landscape orientation or the legal size when the size of the document length (the variable A) is determined.

FIG. 6 is a flow chart for showing a document size determination method according to a preferred embodiment of the present invention. If a document is fed at the position of the reflection plate 121 (S610), the control unit 140 controls the light projection unit 111 to project light onto the document (S620).

The reflection plate 121 reflects the light projected to the position at which the document is fed over the reflection plate 121. The light reception unit receives the light reflected by the reflection plate 121 to form an image (S630). Since the reflection plate 121 has a predetermined pattern and the document located over the reflection plate 121 partially or entirely covers up the pattern provided in the reflection plate 121, the pattern appearing on the formed image is different depending upon the document sizes.

The control unit 140 determines the document size based on the pattern appearing on the image formed by the light reception unit 150 (S640). Therefore, the document size can be determined based on the width of the fed document.

In the meantime, the control unit 140 measures the time during which the document sensing unit 120 turns on, and determines the document size based on the document length accordingly (S650). The document sensing unit 123 is mounted along the document feeding path 125, and can operate in the manner that it turns on when sensing the front end of the document as the document is fed along the document feeding path and turns off when the document completely passes through the document sensing unit 123 in the length direction of the document. Thus, the control unit 140 calculates the time it takes the document to pass through the document sensing unit by measuring the number of pulses to drive the motor, and determines the document size based on the document length corresponding to the calculated time (S660).

The control unit 140 combines the document size based on the determined document width with the document size based on the document length to determine the document size (S660). Referring to FIG. 5, possible document sizes can be determined in combination of the document width and length. Accordingly, the document size determination device can determine the document size by locating the corresponding document widths and lengths in the table.

As described so far, the document size determination device and method for image-forming apparatus according to an embodiment of the present invention determine a document size based on a document length according to the turn-on time of the document sensing unit mounted along the document feeding path, determines a document size based on the document width according to a pattern of the reflection plate appearing on an image formed by the light projected onto and reflected from the document, and determines an actual document size using the combination of the document width and length.

Accordingly, in case of photocopying documents of plural sizes when using the automatic document feeder, the present invention can sort the documents based on the document sizes and supply sheets of copy paper to fit the document sizes without re-setting the image forming apparatus for different document sizes. This simplifies the manufacturing as well as minimally affects manufacturing costs since the document size can be determined using existing image-forming apparatuses without additional hardware.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. An image-forming apparatus, comprising:

a light projection unit for projecting light onto a document;

a reflection plate having a predetermined pattern corresponding to a size of the document, and for reflecting the light projected onto the document;

a light reception unit for receiving the reflected light and forming an image; and a control unit for determining a size of the document based on a width of the document according to a pattern appearing on said image.

2. The image-forming apparatus as claimed in claim 1, further comprising a document sensing unit disposed on a path along which the document is fed to the reflection plate, wherein the control unit measures the time during which the document passes through the document sensing unit and determines the document size based on a length of the document.

3. The image-forming apparatus as claimed in claim 2, wherein the control unit combines the document sizes based on the document width and length and determines the document size.

4. The image-forming apparatus as claimed in claim 1, wherein the predetermined pattern is a plurality of marks located in predetermined positions according to the different document sizes based on document width.

5. A document size determination method for an image-forming apparatus, comprising steps of:

projecting light onto a document in order to reflect the light projected onto the document by a reflection plate provided with a predetermined pattern corresponding to a size of the document;

receiving the reflected light and forming an image; and determining the size of the document based on a width of the document according to a pattern appearing on the image.

6. The document size determination method as claimed in claim 5, further comprising a step of measuring the time during which the document passes through a document sensing unit disposed on a path along which the document is fed to the reflection plate, and determining the document size based on document length.

7. The document size determination method as claimed in claim 6, further comprising a step of combining the document sizes based on the document width and length, and determining the document size.

8. The document size determination method as claimed in claim 5, wherein the predetermined pattern is a plurality of marks located at predetermined positions based on the width of the document.

* * * * *